United States Patent [19]

St. Laurent et al.

[11] Patent Number: 4,705,458

[45] Date of Patent: Nov. 10, 1987

[54] FLUID OPERATED PUMP

[75] Inventors: Wilfred St. Laurent, Marblehead; Christos Athanassiu, Boston, both of Mass.

[73] Assignee: Bellofram Corporation, Burlington, Mass.

[21] Appl. No.: 619,407

[22] Filed: Jun. 12, 1984

Related U.S. Application Data

[63] Continuation-in-part of Ser. No. 403,758, Jul. 30, 1982, abandoned.

[51] Int. Cl.[4] ..... F04B 43/06

[52] U.S. Cl. ..... 417/46; 91/346; 92/98 D; 92/103 SD; 417/393

[58] Field of Search ..... 92/103 SD, 98 R, 98 D; 417/393, 395, 41, 46; 91/344, 346

[56] References Cited

U.S. PATENT DOCUMENTS

| | | | |
|---|---|---|---|
| 740,892 | 10/1903 | Meyer | 417/393 |
| 1,839,540 | 1/1932 | Farr | 91/329 |
| 2,765,743 | 10/1956 | Hollinshead | 417/44 |
| 3,192,865 | 7/1965 | Klempay | 417/333 |
| 3,730,217 | 5/1973 | Gute | 137/512.4 |
| 3,823,739 | 7/1974 | McMullan | 251/73 |
| 4,035,107 | 7/1977 | Kesten et al. | 92/98 R |
| 4,381,180 | 4/1983 | Sell | 417/393 |
| 4,540,349 | 9/1985 | Du | 417/393 |
| 4,544,328 | 10/1985 | Credlee, Jr. | 417/46 X |

FOREIGN PATENT DOCUMENTS

| | | | |
|---|---|---|---|
| 564518 | 10/1958 | Canada | 92/103 F |
| 61706 | 6/1982 | European Pat. Off. . | |

*Primary Examiner*—Leonard E. Smith

*Attorney, Agent, or Firm*—Fay, Sharpe, Beall, Fagan, Minnich & McKee

[57] ABSTRACT

A fluid operated pump comprising a housing including first and second cylinders. First and second pistons are rigidly fixed to each other and situated in their respective cylinders, the cylinders alternately receiving pressurized fluid for operating the pump. The pump includes novel valving means and novel seals.

8 Claims, 4 Drawing Figures

FLUID OPERATED PUMP

BACKGROUND OF THE INVENTION

This invention is a continuation-in-part of our application Ser. No. 403,758, filed Jul. 30, 1982, which is now abandoned and hereby incorporated by reference. This invention relates to fluid-operated pumps.

It has been known for many years to provide a fluid-operated pump having two pistons and two cylinders and operated by a fluid pressure alternating in the two cylinders so as to move the pistons back and forth. In order to operate this type of pump, some kind of working fluid must be provided, and a valving apparatus must be used so that the working fluid alternately enters and exits each cylinder. The devices of the prior art provide various valving means for supplying the working fluid. Most of these valving means are quite complicated and involve several moving parts. The mechanism for timing the valving means properly so that the working fluid enters and leaves the appropriate chamber at the appropriate time is susceptible to misadjustment and failure, and the valving means itself is susceptible to jamming or wearing. Excessive wear may cause the loss of a seal around the valving means.

A second set of valving means is also required in order to control the movement of the pumped fluid. This second set of valving means generally includes four separate valves, each operating in its own chamber.

If fabric-reinforced diaphragm seals are used, there may be a problem with wicking of fluid through the fibers of the fabric. Solving that problem by terminating the fabric short of the outer perimeter of the diaphragms requires a difficult manufacturing procedure.

When the fluid which is pumped is in a vat or jug or other batch-type of container, problems may arise when the fluid supply is exhausted. If the container is open, the pump would begin to pump air. If the container is closed, the pump would begin to pull a vacuum.

SUMMARY OF THE INVENTION

The present invention provides a very simple fluid-operated pump, in which the valving means controlling the flow of the working fluid is a single, integral member having two positions. The term "valving means" as used here for valving the working fluid is meant to be exclusive of seals, although seals may be located around the valving means. Since only one part moves, there is greater reliability in this pump than in pumps in which the working fluid valving means comprises more than one moving part. Also, because there is only one moving part, there is less surface area which rubs due to movement of the part, and therefore less friction and less wear on the components. It is also easier to seal a single, integral member than to seal several members. Furthermore, this single, integral member may be easily removed from the housing in order to replace seals, if that becomes necessary.

The embodiment of the present invention shown here also provides a simple detent means for stopping the valving member at its first and second positions; namely, there is a pair of axially spaced cannelures or grooves in the outer surface of the valving member and two spring-loaded balls in the housing adapted to fit into one or the other of the grooves when the valving means reaches either of its two operative positions. The two spring-loaded balls oppose each other so that the force on the valving member is balanced. This means that a large force can be applied by the spring-loaded balls without causing the valving member to deviate from its axially-oriented direction of travel and without causing high friction forces on the valving member.

In the embodiment shown here, the seals between each piston and its cylinder are rolling diaphragm seals, made of a fabric-reinforced polymer. These seals differ from the standard rolling diaphragm seal in that they include a number of V-shaped ribs, without fabric reinforcement, which are positioned toward the outer perimeter of the diaphragms to prevent wicking of fluids through the fibers of the fabric, so that there is a good seal around the perimeter of the diaphragm.

This embodiment also includes a novel valving means for controlling the flow of the pumped fluid. The valving shown here is made up of two sets of coaxial umbrella valves, each set operating in a single chamber of the pump.

In addition, the present invention includes a gas supply cut-off mechanism, which stops the pump when the supply of fluid to be pumped is depleted.

DESCRIPTION OF THE PREFERRED EMBODIMENT

Figure 1:
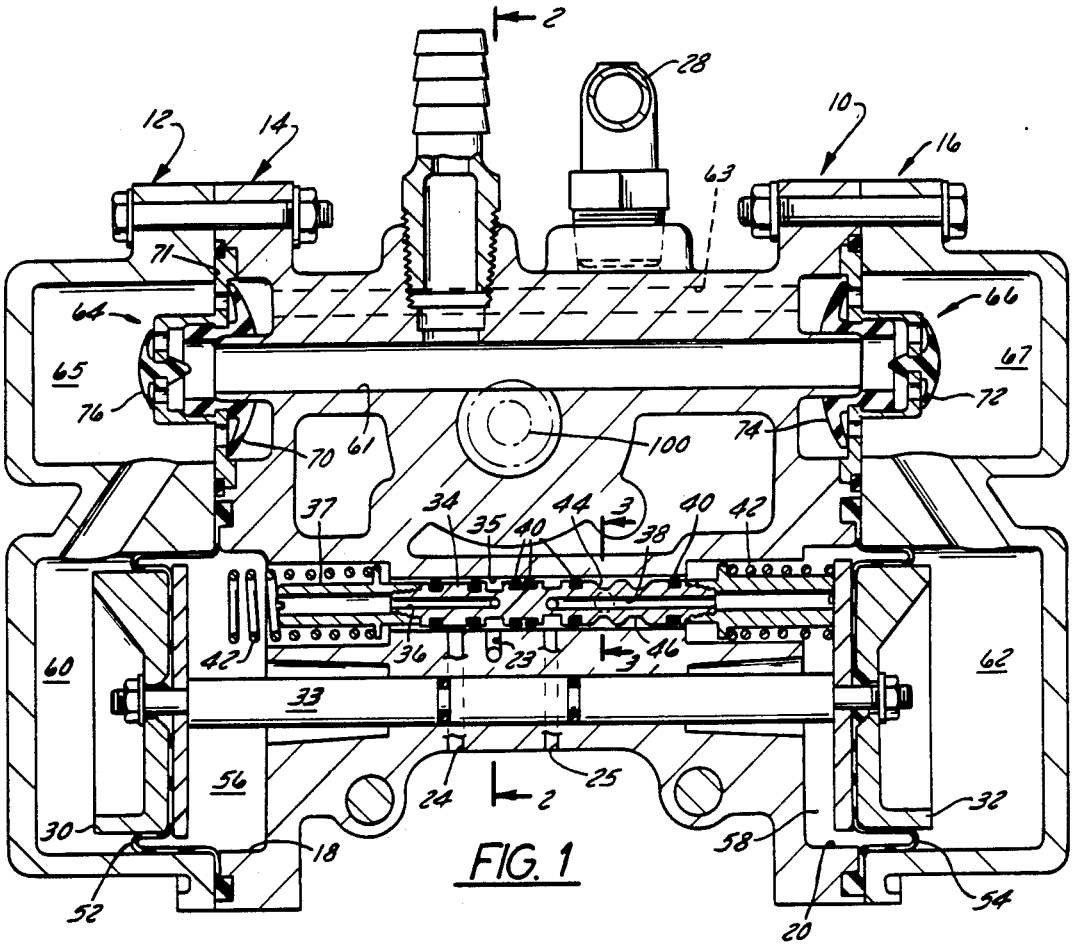
FIG. 1 is a sectional view of the pump of the present invention.
Figure 2:
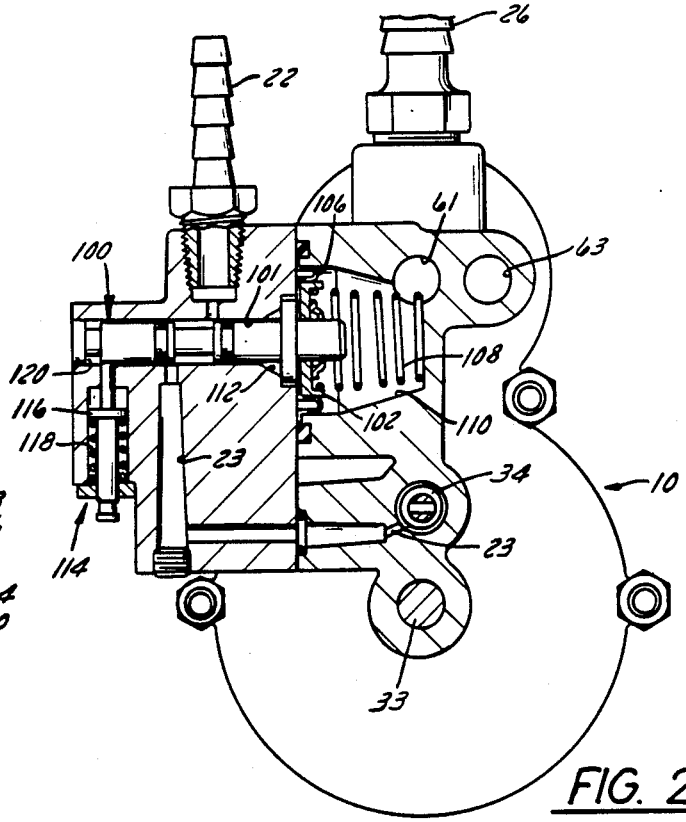
FIG. 2 is a view of the pump taken generally along the section 2—2 of FIG. 1.

FIG. 1 shows a fluid-operated pump 10. The pump shown here was originally designed for pumping soda syrup but may be used in many other applications. The housing of the fluid pump 10 is made in three pieces 12, 14, and 16. Inside the housing are a first cylinder 18, a second cylinder 20, a working fluid inlet port 22, two working fluid outlet conduits 24, 25, a pumping fluid inlet port 26, and a pumping fluid outlet port 28. The first and second working fluid outlet conduits 24, 25 may exit the housing in two separate ports, as shown, or they may intersect and exit the housing at a single outlet port. A first piston 30 and a second piston 32 are rigidly connected to each other by means of a rod 33 and are situated such that each piston is in its respective cylinder 18, 20.

A spool valve 34 operates in a bore 35 between the cylinders 18, 20 as a working fluid valving means for alternately providing working fluid first to the first cylinder 18 and exhausting the second cylinder 20 and then providing working fluid to the second cylinder 20 and exhausting the first cylinder 18. It is contemplated that the working fluid will be a pressurized fluid such as compressed air, which then exhausts into atmosphere. The spool valve 34 includes a first internal conduit 36, which is in constant fluid communication with the first cylinder 18, and a second internal conduit 38, which is in constant fluid communication with the second cylinder 20.

There is a plurality of O-ring seals 40 which seal between the spool valve 34 and the bore 35 in the housing 14. At each end of the spool valve 34 is a spring retainer portion 37, on which is mounted a spring 42.

The spring retainer 37 is of such a length that it prevents the spring from compressing completely. It has been found that allowing the spring to compress solid (100%) causes undesirable stresses on the spring. Therefore, the retainer 37 permits the spring 42 to compress only 85–90% before the piston 30 or 32 contacts its respective retainer 37, causing the spool valve 34 to begin moving. Once the spool valve 34 begins to move, the stored force in the spring 42 carries the spool valve 34 to its next position.

Figure 3:
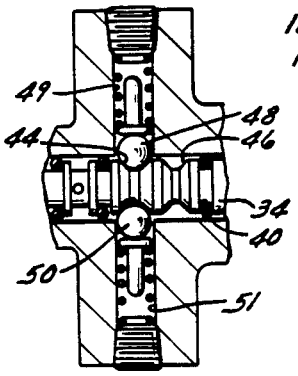
FIG. 3 is an enlarged, broken-away sectional view taken generally along the section 3—3 of FIG. 1 and showing the detent mechanism.

The spool valve 34 also has a detent means (shown in FIG. 3) for holding the valve in either of two operative positions. The detent means includes two grooves 44, 46 in the outer surface of the spool valve 34, and a pair of opposed, spring-loaded balls 48, 50 in suitable transverse bores 49, 51 in the housing 14. As shown in FIG. 3, the two spring-loaded balls 48, 50 are adapted to fit into the annular grooves 44, 46 to stop the spool valve 34 at two positions. The spring-loaded balls 48, 50 are situated opposite each other so that the force on the spool valve 34 is balanced. Because the two ends of the spool valve 34 always see different pressures, there is always a force tending to push the spool valve in one direction or the other. There must be sufficient force applied to the spool valve 34 so that it does not move due to that force. In this embodiment, that force is provided by the spring-loaded balls 48, 50. If a large, unbalanced transverse force were applied to the spool valve, for example, if there were only one spring-loaded ball, the friction force on the spool valve 34 might tend to cause the spool valve to bind. However, with the balanced, opposed balls 48, 50, a large force can be applied in order to retain the spool valve in its position without causing the spool valve to bind.

In each cylinder 18, 20 is a rolling diaphragm seal 52, 54 which seals between each piston 30, 32 and its respective cylinder 18, 20. Each diaphragm seal 52, 54 separates its respective cylinder 18, 20 into inner chambers 56, 58 and outer chambers 60, 62. The inner chambers 56, 58 are in constant fluid communication with the spool valve 34, and are adapted to receive the working fluid.

Figure 4:
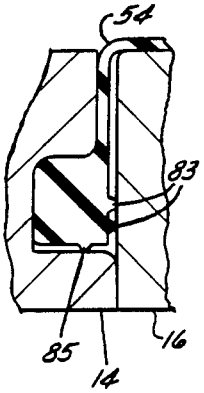
FIG. 4 is an enlarged, broken away view of the edge of the rolling diaphragm seal shown in FIG. 1.

It should be noted that the diaphragms 52, 54 are made of a fabric-reinforced polymer. A plurality of V-shaped ribs 83, 85, made entirely of the polymeric material is located near the outer perimeter of the diaphragm and is clamped in the housing. As shown in FIG. 4, the outer edge of the diaphragm 54 is square, with one V-shaped rib 85 located on the outermost surface, and two V-shaped ribs 83 located on the adjacent surface approximately ninety degrees from the outermost surface. The V-shaped ribs 83, 85 are shown as being partially compressed in FIG. 4, as they are clamped against the housing. These ribs provide a good seal so that fluid is not wicked through the fibers of the fabric and cannot pass through into the pump chambers. The manufacturing of this type of seal is much easier than the manufacturing of a seal in which the fabric stops short of the outermost surface of the diaphragm, as was disclosed in our earlier application.

The outer chambers 60, 62 are in fluid communication with the pumping fluid inlet and outlet ports 26, 28 by way of conduits 61 and 63 and are adapted to receive the fluid which is being pumped. Between the outer chambers 60, 62 and the pumping inlet and outlet ports 26, 28 are located two valve chambers 65, 67 containing the pumping fluid valving means 64, 66 which regulate the flow of the pumped fluid so that the fluid is pumped into the housing through the pumping fluid inlet port 26 and out of the housing through the pumping fluid outlet port 28. In this case, the pumping fluid valving means is made of two sets of coaxial umbrella valves 64, 66, said valves being in fluid communication with the outer chambers 60, 62 and with the pumping fluid ports 26, 28. The first set of coaxial umbrella valves 64 has an outer umbrella portion 70, which bears against an apertured valve plate 71 to seal the valve chamber 65 from the fluid outlet 28 when the chamber 65 pressure is less than the pumping fluid outlet pressure but flexes to allow pumped fluid to move from the first outer chamber 60 and the valve chamber 65 to the pumping fluid outlet port 28 when the pressure in the chamber 65 exceeds the outlet pressure. The valve set 64 also includes an inner umbrella portion 76, which operates in the same manner as the outer umbrella portion but allows pumped fluid to move from the pumping fluid inlet port 26, through the valve chamber 65 and into the first outer chamber 60 when the pressure in chambers 65 and 60 is less than the inlet pressure, but which closes when the pressure in chambers 65 and 60 exceeds the inlet pressure. Likewise, the second set of coaxial umbrella valves 66 has an outer umbrella portion 74, which permits pumped fluid to move from the second outer chamber 62 to the pumping fluid outlet port 28 while preventing movement of fluid in the opposite direction, and an inner umbrella portion 72, which flexes to permit fluid to move from the pumping fluid inlet port 26 to the second outer chamber 62 while preventing movement of fluid in the opposite direction.

A cut-off valve 100 is provided to stop the operation of the pump 10 when the supply of fluid to be pumped is depleted. The cut-off valve 100 operates in its own valve chamber and includes a spool valve 101 and a piston 102 mounted on an extension 104 of the spool. A rolling diaphragm seal 106 seals between the piston 102 and the pump housing to divide this valve chamber into two parts. The piston 102 is biased toward the left by a spring 108. The chamber 110 on the right of the piston 102 is in communication with the pumping fluid inlet conduit 61. The chamber 112 on the left of the piston 102 is in communication with atmosphere. When the spool valve 101 is in the "open" position, working fluid passes from the working fluid inlet port 22 through the spool valve 101 and into the working fluid inlet conduit 23. When the spool valve 101 is in the "closed" position, communication between the working fluid inlet port 22 and the working fluid inlet conduit 23 is closed.

During normal operation of the pump, when there is fluid in the sealed container (not shown) which is connected to the pumping fluid inlet 26, the cut-off valve 100 is biased to the left by the spring 108, so the valve 101 is open, permitting fluid to pass from the working fluid inlet port 22 to the working fluid inlet conduit 23, and then to the working fluid valving means 34. It is contemplated by the present invention that the fluid to be pumped is held in a collapsible, sealed container. As the container of pumped fluid is emptied, it collapses, and the pressure in the pumping fluid inlet conduit 61 drops to below atmospheric. The atmospheric pressure of the chamber 112 pushes the piston 102 to the right, against the force of the spring 108. The movement of the spool valve 101 toward the right causes the spool valve to shut off fluid communication between the working fluid inlet port 22 and the working fluid inlet conduit 23, thereby shutting off the pump.

The cut-off valve which is shown here includes a spring-loaded reset 114, which completely shuts off the pump when the spool valve 101 moves toward the right. The reset 114 includes a plunger 116, a spring 118, and a notch 120 defined by the spool valve 101 into which the end of the plunger 116 fits. When the spool valve 101 moves toward the right, the spring 118 forces the plunger 116 to move into the notch 120, so as to keep the spool valve 101 in the closed position. The reset plunger 116 must be pulled outward again in order to restart the pump. The pump need not include such a reset mechanism, in which case operation of the cut-off valve 100 depends entirely on the pressure difference across the diaphragm 106.

Operation of the fluid motor 10 is as follows: When the spool valve 34 is in its first position, with the balls 48, 50 located in the groove 44, as shown in FIGS. 1 and 3, the working fluid enters the first inner chamber 56 through the working fluid inlet conduit 23 and through the first internal conduit 36 in the spool valve 34. At the same time, the second inner chamber 58 is exhausted through the second internal conduit 38 and through the second working fluid outlet conduit 25. Because a high pressure is acting on the first piston 30 while a low pressure acts on the second piston 32, the pistons move toward the left. When the pistons move toward the left, any fluid which is in the first outer chamber 60 will be pumped through the outer umbrella portion 70 of the coaxial umbrella valves 64 and will leave the housing through the pumping fluid outlet port 28. At the same time, pumped fluid is pulled into the second outer chamber 62 through the pumping fluid inlet port 26 and through the inner umbrella portion 72 of the second set of coaxial umbrella valves 66. As the second piston 32 moves toward the left, it compresses the spring 42 at the right end of the spool valve 34. The right spring 42 stores up the force from the second piston 32 until the spring is compressed 85–90% at which point the piston 32 contacts the right spring retainer 37, jarring the balls 48, 50 out of the groove 44. Then the stored spring force pushes the spool valve 34 toward the left until the balls 48, 50 rest in the groove 46. (FIG. 1 shows the pump with the pistons 30, 32 having moved toward the left until the right piston 32 just contacts the spring retainer 37 and before the spool valve 34 has moved.)

The spool valve 34 is now in its second position (not shown), and the working fluid communication with the inner chambers 56, 58 is reversed. The working fluid enters the inner chamber 58 through the working fluid inlet port 22, past the cut-off valve 100, through the working fluid inlet conduit 23, and through the second internal conduit 38. At the same time, the first inner chamber 56 is exhausted through the first internal conduit 36 and through the first working fluid outlet conduit 24. Because the second piston 32 now sees a high pressure while the first piston 30 sees a lower pressure, the pistons will move toward the right. This causes the pumped fluid in the second outer chamber 62 to be pumped out through the outer umbrella portion 74 of the coaxial valves 66 and out the pumping fluid outlet 28. At the same time, pumped fluid will be pulled into the first outer chamber 60 through the pumping fluid inlet 26 and through the inner umbrella portion 76 of the first valves 64. This will continue until the first piston 30 compresses the left spring 42 and then hits the left spring retainer 37, dislodging the balls 48, 50 from the second groove 46, so that the spool valve 34 moves to the right until the balls 48, 50 fit into the first groove 44, returning the spool valve to its first position, where the process will be repeated.

When the container of fluid which is to be pumped has emptied, the pressure in the pumping fluid inlet conduit 61 will drop, pulling the cut-off valve 100 to the right, closing off communication with the working fluid and thereby shutting off the pump. When a new container of fluid is attached to the pumping fluid inlet 26 and the reset button (if there is one) is pulled back out, the pump will again begin normal operation.

Thus, the present embodiment of the invention provides a simple working fluid valving means made up of a single spool valve adapted to move to two operative positions. The movement of the spool valve is controlled by the pistons which push the spool valve as they move back and forth, by the spring which stores the force of the piston, by the spring retainer, which is contacted by the piston, and by the spring-loaded balls which stop the spool valve at its two positions. This mechanism is simple, easily timed so that fluid communication opens and closes at the correct time, and is balanced to reduce the opportunity for hang-ups and jamming and to increase the probability for smooth operation. This mechanism is likely to experience less wear than devices of the prior art and is easily repaired in the event a malfunction does occur.

This invention includes a simplified valving for the pumped fluid, an improved means for sealing with a fabric-reinforced polymeric diaphragm, and a cut-off valve for stopping the pump when the supply of fluid to be pumped is exhausted, all of which improve the operation of the pump.

While the embodiment as shown and described herein is the preferred embodiment of the present invention, it will be obvious to those skilled in the art that various modifications may be made to this embodiment within the scope of the present invention.

What is claimed is:

1. A fluid operated pump, comprising:

a. first and second pistons rigidly fixed to each other;

b. a housing including first and second cylinders situated such that each of said pistons is in its respective cylinder;

c. first and second flexible seals acting to seal between said pistons and their respesctive cylinders so as to define inner and outer chambers in each of said cylinders;

d. said housing having an inlet conduit for receiving working fluid from a working fluid inlet port and first and second outlet conduits for exhausting said working fluid;

e. working fluid valving means comprising a spool valve which has first and second internal conduits in constant fluid communication with the inner chambers of said first and second cylinders, respectively, said spool valve being adapted to move to two different positions such that, in the first position, said first internal conduit is in fluid communication with said inlet conduit, and said second internal conduit is in fluid communication with said second outlet conduit, and, in the second position, said first internal conduit is in fluid communication with said first outlet conduit and said second internal conduit is in fluid communication with said inlet conduit;

f. means for moving said working fluid valving means between said first and second positions;

g. means for retaining said working fluid valving means at said first and second positions, including a groove in said spool valve and a pair of opposed, spring-loaded balls adapted to fit in said groove; and, h. a cut-off valve for stopping the operation of said pump when the supply of fluid to be pumped is exhausted by interrupting fluid communication between said working fluid inlet port and said working fluid inlet conduit, and comprising a piston and a biasing means for biasing said piston to keep said cut-off valve in an open position during normal operation of the pump.

2. A fluid-operated pump as recited in claim 1, wherein said housing further defines a pumping fluid inlet conduit, which communicates with said cut-off valve such that said cut-off valve closes when the pressure in said pumping fluid inlet conduit drops below atmospheric pressure, and wherein said biasing means includes a biasing spring for maintaining said cut-off valve in the open position during normal operation of the pump.

3. A fluid-operated pump as recited in claim 2, further comprising a spring-loaded reset mechanism for maintaining said cut-off valve in the closed position once said cut-off valve has closed.

4. A fluid operated pump, comprising:

a. first and second pistons rigidly fixed to each other;

b. a housing including first and second cylinders situated such that each of said pistons is in its respective cylinder;

c. first and second flexible seals acting to seal between said pistons and their respective cylinders so as to define inner and outer chambers in each of said cylinders;

d. said housing having an inlet conduit for receiving working fluid and first and second outlet conduits for exhausting said working fluid;

e. working fluid valving means comprising a spool valve which has first and second internal conduits in constant fluid communication with the inner chambers of said first and second cylinders, respectively, said spool valve being adapted to move to two different positions such that, in the first position, said first internal conduit is in fluid communication with said inlet conduit, and said second internal conduit is in fluid communication with said second outlet conduit, and, in the second position, said first internal conduit is in fluid communication with said first outlet conduit and said second internal conduit is in fluid communication with said inlet conduit;

f. said spool valve having first and second spring retainers respectively on its first and second ends, and including first and second springs mounted on said first and second spring retainers, respectively, wherein said spring retainers are of such a length as to prevent said springs from compressing completely such that, as said pistons travel in one direction, one of said pistons compresss one of said springs to within 85 to 90% of its fully compressed position and then contacts the respective spring retainer so as to move said spool valve in the direction in which said pistons are travelling; and, g. means for retaining said working fluid valving means at said first and second positions, including a groove in said spool valve and a pair of opposed, spring-loaded balls adapted to fit in said groove.

5. A fluid-operated pump as recited in claim 2 or 4, wherein said housing further defines a pumping fluid outlet conduit, and further comprising pumping fluid valving means for controlling the flow of pumped fluid into and out of the outer chambers of said first and second cylinders and into and out of said pump, said pump fluid valving means comprising two sets of coaxial umbrella valves, each of said sets of coaxial umbrella valves operating in a single chamber of said pump.

6. A fluid operated pump as recited in claim 2 or 4, wherein said first and second flexible seals comprise rolling diaphragm seals made of a fabric-reinforced polymer, and wherein said diaphragms include a plurality of ribs located around the outer perimeter such that said ribs are clamped in said housing.

7. A fluid operated pump as recited in claim 6, wherein said ribs have a V-shaped cross section and are made entirely of said polymer.

8. A fluid operated pump as recited in claim 7, wherein the outermost edge of each of said diaphragms is square, so as to include an outermost surface and an adjacent surface, approximately perpendicular to said outermost surface, with one of said V-shaped ribs located on said outermost surface and one of said V-shaped ribs located on said adjacent surface, both of said ribs being clamped against said housing.

* * * * *